United States Patent [19]

Jackson

[11] Patent Number: 4,648,326

[45] Date of Patent: Mar. 10, 1987

[54] RADIAL AXLE RAILWAY TRUCK WITH AXLE COUPLINGS AT SIDES TRANSVERSELY INTERCONNECTED WITH EACH OTHER

[75] Inventor: Keith L. Jackson, Creve Coeur, Mo.

[73] Assignee: Lukens General Industries, Inc., Coatesville, Pa.

[21] Appl. No.: 748,406

[22] Filed: Jun. 24, 1985

Related U.S. Application Data

[63] Continuation-in-part of Ser. No. 704,563, Feb. 22, 1985, abandoned.

[51] Int. Cl.[4] ..... B61F 5/30

[52] U.S. Cl. ..... 105/168; 105/138; 105/224.1; 105/182.1; 105/199.1

[58] Field of Search ..... 105/131, 133, 134, 136, 105/138, 165, 167, 168, 157 R, 197 T, 224 R, 224.1, 218 R, 182 R, 182 E, 135, 199 F

[56] References Cited

U.S. PATENT DOCUMENTS

| | | | |
|---|---|---|---|
| 2,410,402 | 11/1946 | Ledwinka | 105/224.1 |
| 3,693,553 | 9/1972 | Lich | 105/199 F |
| 3,799,066 | 3/1974 | Jackson | 105/182 R |
| 3,862,606 | 1/1975 | Scales | 105/167 |
| 3,926,127 | 12/1975 | Shima | 105/224 R |
| 4,170,179 | 10/1979 | Vogel | 105/168 |
| 4,170,945 | 10/1979 | Kayserling | 105/133 |
| 4,231,296 | 11/1980 | Jackson | 105/199 F |
| 4,258,629 | 3/1981 | Jackson et al. | 105/182 R |
| 4,480,553 | 11/1984 | Scheffel | 105/167 |

FOREIGN PATENT DOCUMENTS

| | | | |
|---|---|---|---|
| 402421 | 2/1968 | Australia | 105/182 E |
| 837711 | 3/1952 | Fed. Rep. of Germany | 105/168 |
| 127684 | 10/1959 | U.S.S.R. | 105/168 |

*Primary Examiner*—Robert B. Reeves
*Assistant Examiner*—Donald T. Hajec
*Attorney, Agent, or Firm*—F. Travers Burgess

[57] ABSTRACT

A railway motor truck has a pair of wheeled axles, the wheels having profiled treads to effect self-steering and the axles resiliently supporting a truck frame with sufficient yaw freedom to accommodate wheel-induced steering movements, and an interconnection between the axles, comprising a transverse shaft journaled in the truck frame intermediate the axles, normally substantially vertical levers affixed to the end portions of the shaft, and a pair of links respectively connecting the opposite ends of one axle to the upper and lower ends of the respective levers, and a second pair of links respectively connecting the opposite ends of the other axle to the opposite ends of the respective levers. Axle-to-axle load transference is substantially prevented by traction connections between the truck and a supported vehicle body effecting traction transmission therebetween substantially at rail level, and pitching of the truck frame from motor torque reaction is minimized and vertical and yawing movements of the axles are facilitated by the provision of a quill drive and rigidly mounting the traction motors on the truck frame.

17 Claims, 13 Drawing Figures

RADIAL AXLE RAILWAY TRUCK WITH AXLE COUPLINGS AT SIDES TRANSVERSELY INTERCONNECTED WITH EACH OTHER

REFERENCE TO RELATED APPLICATION

This application is a continuation-in-part of my copending application, Ser. No. 704,563, filed Feb. 22, 1985, now abandoned.

BACKGROUND OF THE INVENTION

1. Field of the Invention

The invention relates to railway rolling stock and consists particularly in a truck having a pair of self-steering axles interconnected at the sides of the truck to accommodate steering movements of the axles in opposite senses while opposing hunting of the axles.

2. The Prior Art

As seen in Herbert Scheffel U.S. Pat. Nos. 4,067,261 and 4,067,262; my U.S. Pat. No. 4,134,343; K. L. Jackson and J. J. Reese U.S. Pat. No. 4,237,791; K. L. Jackson, W. C. Jones and K. E. Spencer U.S. Pat. No. 4,238,791; K. L. Jackson, J. J. Reese and K. E. Spencer U.S. Pat. No. 4,258,629; and K. L. Jackson, D. L. Schmitt and J. L. Schauster U.S. Pat. No. 4,429,637, radial axles have frequently been applied to non-motorized trucks in which wheel tread conicity has been utilized to make the axles self-steering. In these trucks, links extending diagonally of the truck and pivotally connected to the diagonally opposite axle bearings are provided to oppose hunting movements of the wheel and axle assemblies and to couple wheel-induced yawing movements of the wheel and axle assemblies in opposite directions on curved track so as to avoid interference with their self-steering ability.

It will be seen that the use of diagonal links in the manner taught in the aforementioned patents of Scheffel, Jackson and Jackson et al, would be incompatible with a motor truck having motors positioned between the wheels and adjacent to and drivingly connected to both axles.

SUMMARY OF THE INVENTION

A primary object of the invention is to provide in a radial axle truck of the type having self-steering axles, means other than diagonal links connecting diagonally opposed axle boxes for maintaining the longitudinal spacing of the wheel and axle assemblies and maintaining them in parallelism during movement along tangent track opposing hunting movements of the wheel and axle assemblies and for coupling wheel-induced yawing movements of the wheel and axle assemblies in opposite directions on curved track so as to avoid interference with their self-steering ability.

The above object is attained by connecting the axle boxes at the respective sides of the truck by a Z-linkage comprising a substantially upright lever intermediate the axles and links connecting the respectively opposite ends of each lever with the axle boxes at the respective side of the truck, the normally upright levers being secured to the ends of a transverse shaft journaled in the truck framing, whereby to maintain the axles in parallelism on tangent track while permitting equal and opposite turning movements of the axles in the horizontal plane on curved track.

A further object of the invention is to incorporate the axle coupling mechanism referred to above in high adhesion motor trucks.

A further object of the invention is to provide means whereby parasitic longitudinal movements of the Z-link resulting from tilting of the truck frame about the low traction transmission point and from the resilient support of the truck frame on the journal boxes and consequent longitudinal movements of the journal boxes is eliminated.

A still further object is to achieve the previous object by journaling the transverse shaft in longitudinal beams substantially non-resiliently supported from the journal boxes at each side.

A further object is to provide a motor and drive arrangement compatible with radial movements of the axles and connected to the truck frame in such a way as to minimize motor torque reaction induced pitching of the truck frame.

DETAILED DESCRIPTION OF THE INVENTION

Figure 1:
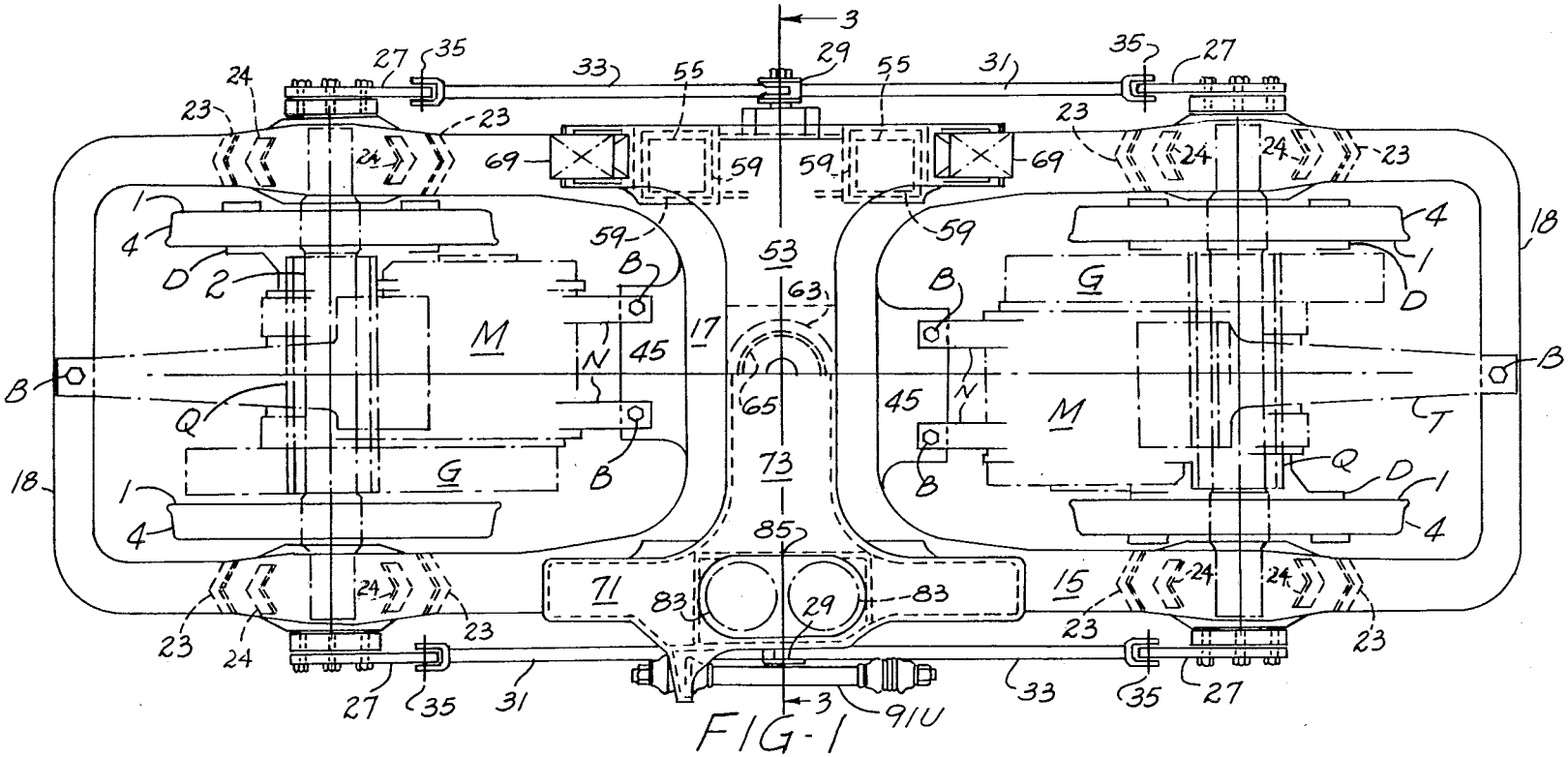
FIG. 1 is a plan view of a form of truck embodying the invention.

The truck illustrated in the drawings has a pair of spaced wheel and axle assemblies, each comprising railway flanged wheels 1 mounted in gauged pairs on the ends of the respective axles 2 and 3. The effective conicity of the wheel tread profiles 4 is sufficient to affect self-steering of each wheel and axle assembly by means of the differential effect between the rail-contacting wheel diamters of the outer and inner wheels on curved track and is substantially greater than the standard wheel tread conicity of 1:20 or 0.05, preferably being between 1:10 and 1:5. Journal bearing boxes 5 are mounted on the projecting journal portions of axles 2 and 3 and are formed with longitudinally projecting wings 7 on which are seated flat elastomeric pad devices 9, and generally inverted U-shaped yokes 11 embracing journal boxes 5 have their downwardly facing terminals 13 supported on pads 9.

A truck frame comprises longitudinally extending side members 13 connected at their midpoints by transverse center transom 17 and at their ends by transverse end transoms 19. Each side member 13 has at its ends downwardly open pedestal openings 21 embracing yokes 11.

The sides 23 of the respective pedestal openings 21 are inclined toward each other longitudinally of the truck and the outer surfaces 24 of the yokes 11 are similarly inclined and are respectively of concave and convex V-shape in the horizontal plane, and chevron-shaped elastomeric and metal pad devices 25 are interposed between the respective concave and convex surfaces to provide a vertically yieldable support for the truck frame 15, 17 for cushioning the truck frame against shocks received from the track rails and maintaining the respective wheels 1 in full engagement with the track rails irrespective of vertical irregularities in the latter.

Figure 1A:
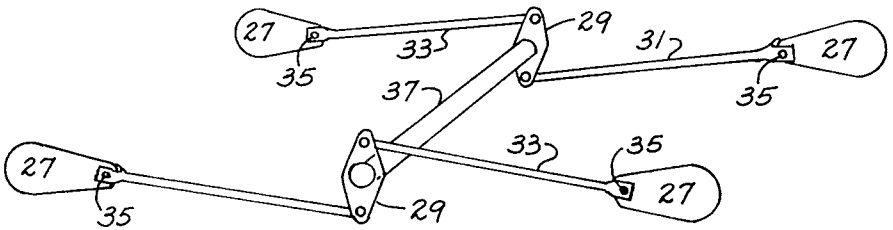
FIG. 1A is a perspective view of the axle interconnection system.

As best seen in FIGS. 1 and 1A, for maintaining the longitudinal spacing of the wheel and axle assemblies 1, 2 and 1, 3 and maintaining them in parallelism, as well as for opposing hunting movements of the wheel and axle assemblies during movement along tangent track and for coupling wheel-induced turning movements of the wheel and axle assemblies in the horizontal plane in opposite directions on curved track so as to avoid interference with their self-steering ability, journal bearing boxes 5 at each side of the truck rigidly mount mounting paddles 27. Longitudinally extending links 31 and 33 are pivotally connected at their opposite ends to mounting paddles 27 by clevises and pins 35 and by pins 36 to the opposite ends of upright levers 29 fixed to the ends of a transverse shaft 37 rotatably journaled at 39 in brackets 41 on truck frame side members 15 intermediate the axles. As best seen in FIG. 1A, the links 33 connected to the upper ends of levers 29 at opposite sides of the truck are connected at their opposite ends to different axles; i.e., link 33 at one side is connected to mounting paddle 27 on axle bearing box 5 on axle 2, and link 33 on the other side is similarly connected to axle 3, the axle connections of bottom links 31 being correspondingly reversed. It will be evident particularly from FIG. 1A that wheel-induced yawing movements of the axles in opposite senses will be freely accommodated by the coupling interconnection comprising Z-linkages 29, 31, 33 and shaft 37 because movement of the inner ends of axles 2 and 3 toward each other on curved track will be accompanied by corresponding movement away from each other of the outer ends of the axles and the foreshortening of the inner Z-linkage will be accompanied by extension of the outer Z-linkage by reason of the alternate rotation of shaft 37. At the same time, any tendency of the wheels of either axle to hunt will be opposed by the interconnection with the other axle.

It will also be evident that by reason of the location of Z-linkages 29, 31, 33 outboard of the truck frame side members, the space between the wheels is unobstructed by the axle-to-axle coupling, thus freeing this space for motors and drive mechanism.

Instead of the conventional axle hung motors with their noses resiliently supported on the center transom, and the attendant disadvantages of such motor suspensions including pitch of the truck frame about a transverse axis resulting from oppositely directed vertical torque reactions on the frame, and the inertia of the axles resulting from the motor load, which would resist wheel-induced steering movements, the traction motors M are supported by noses N on shelves 45 projecting toward the axles from center transom 17 and by motor torque arm T extending over the adjacent axle and resting on the adjacent end transom 18, noses N and torque arm T being rigidly secured to shelf 45 and end transom 18 by suitable means such as bolts B.

To accommodate vertical movements of frame-supported motor M with respect to axles 2 and 3 and yawing movements of the respective axle, the motors M rotatably mount a sleeve or quill surrounding the respective axle and of sufficiently larger inside diameter than the diameter of the axle to clear the axle. Quill Q is drivingly connected to motor M by gears (not shown) in gear box G, and drives wheels 1 through flexible driving connections D.

For supporting the car body and permitting swivel of the truck, a suspension similar to that disclosed in my U.S. Pat. No. 3,797,066 is utilized, in which a sub-bolster of generally H-shape in plan having longitudinally extending side members 51 connected by a transverse central member 53 is slidably supported on loading pads 55 on depressed central portions 57 of truck frame side members 15 by downwardly facing flat horizontal bearing surfaces 59 on sub-bolster side members 51 and at its center transverse member sub-bolster 53 is formed with a depending extension 61 which terminates in an upright cylindrical bearing member 63 pivotally received in a mating cylindrical recess 65 in center transom 17 of the truck frame so that the sub-bolster 51, 53 can swivel about the axis of mating cylindrical bearing members 63, 65. At its sides sub-bolster depending extension 61 is formed with longitudinally elongated apertures 66 to permit the passage therethrough of shaft 61 without interference with swiveling movements of sub-bolster 51, 53.

The upper surfaces of sub-bolster side members 51 slope downwardly at their ends at 67 such that their central normals N intersect substantially at rail level and flat elastomeric pad devices 69 are seated on sloping surfaces 67. The longitudinally extending side members of a main bolster also of H-shape in plan, having a transverse central member 73, have their downwardly facing end surfaces 75 similarly inclined in parallelism with upwardly facing end surfaces 67 of subbolster side members 51 and are seated on elastomeric pad device 69.

With this arrangement, tractive forces acting through the wheels at rail level are effectively transmitted at the same level to bolster 71, 73, thus eliminating any vertical moment arm through which they would otherwise act to tip the truck frame about a transverse axis and thereby reduce the load on one axle and increase it on the other. Bolster 71, 73 is formed at the intersections of its side members 71 and transverse member 73 with upwardly open spring seats 81 and a pair of upright coil springs 83 are seated in each spring seat 81. Springs 83 support the body underframe U through spring caps 85.

In order to maintain the effective level of traction force transmission from the truck to the body at the point of convergence of the compression axes of pad devices 69, i.e., at rail level, means are provided for preventing tilting of the bolster about its axis transverse of the truck relative to the body underframe U and for transmitting draft and retardation forces from the truck to the body underframe. The last-named means comprises transversely projecting vertically elongated brackets 87 on corresponding ends of both bolster side members 71 and similar brackets 89 depending from both sides of the body underframe U in spaced longitudinally aligned relation with bolster brackets 87 and symmetrically placed thereto with respect to the transverse center line of the truck, and at each side a pair of vertically spaced transversely aligned longitudinally extending parallel anchor links 91U and 91L are connected at one end to the respective bolster bracket 87 and at their other end to the respective body underframe bracket 89. Anchor links 91U and 91L are preferably of the type disclosed in James C. Travilla U.S. Pat. No. 3,315,555.

With this arrangement of anchor links 91U and 91L, vertical and lateral movements of body underframe U permitted by vertical deflection and lateral shear in springs 83 are freely accommodated by pivoting of anchor links 91U and 91L about their connections to bolster brackets 87 and underframe brackets 89, but tipping of bolster 71, 73 relative to underframe U about the major axis of the bolster transverse of the truck is prevented as is any relative longitudinal movement between bolster 71, 73 and underframe U.

Operation of the truck illustrated in FIGS. 1–4 is as follows: Upon energization of traction motors M, they act through gears G to rotate quills Q which drive wheels and the respective axles 2 and 3 through resilient driving connections D, causing the truck, and the locomotive body supported thereon to move along the track, elastomeric pads 25 yielding in shear to permit relative vertical movements between the truck frame 15, 17 and the axle bearing box mounted yoke 11, whereby to accommodate the truck to vertical irregularities in the track rails and to cushion the frame from shocks received by the wheels therefrom. As the locomotive rounds a curve in the track, the truck frame swivels about vertical axis pivot members 63, 65, the profiled wheel treads cause axles 2 and 3 to assume positions generally radial of the track curve, such movements of the axles with respect to the truck frame 15, 17 being freely accommodated by shear longitudinally of the truck in horizontal pads 9, and links 31 and 33 on the inner side of the track curve urge inner lever 29 in the counterclockwise direction as viewed from the inner side of the curve, while links 31 and 33 urge outside lever 29 to move in a counterclockwise direction as viewed from the inner side of the curve. Since both levers 29 are fixed to the ends of shaft 37, their movements are identical. Because of the positive coupling action of shaft 37 and linkages 29, 31, 33 both axles are maintained in symmetrical radial positions on curves and parallel to each other on tangent track, any tendencies of either axle to hunt being opposed by the other axle through the coupled linkages. Radial clearance between the axles 2 and 3 and the inner surfaces of quills Q accommodates both vertical movements between the axles and frame permitted by the resilience of elastomeric pads 25 and yawing movements of the axles accommodated by longitudinal shear in elastomeric pads 9. Irrespective of vertical or yawing movements of the axles 2 and 3 with respect to the truck frame, driving torque is transmitted from gear boxes G to the wheels and axles by the flexible driving connections D, which may be of any well-known types such as Westinghouse, Brown-Boveri or Secheron spring devices or the Alsthom, SLM, Siemens or Brown-Boveri universal link devices. Any tendencies of the truck frame to pitch as a result of motor torque reactions which might occur with axle-hung motors with their noses supported on the center transom, and thus displace the axis of shaft 37 from its proper position midway between the axles, are minimized by the provision of truck frame-supported motors M, quills Q and flexible driving connections D. Similarly, any tendency of the frame to tilt about a transverse axis through the normal relatively high level of the truck-to-locomotive body connection is minimized by the secondary suspension of the underframe U on the truck, elements 57 to 89, whereby the effective level of transmission of tractive forces from the truck to the underframe is located at the points of convergence of the normals through pads 69, i.e., at track level in the manner taught in Keith L. Jackson U.S. Pat. No. 3,799,066.

Figure 2:
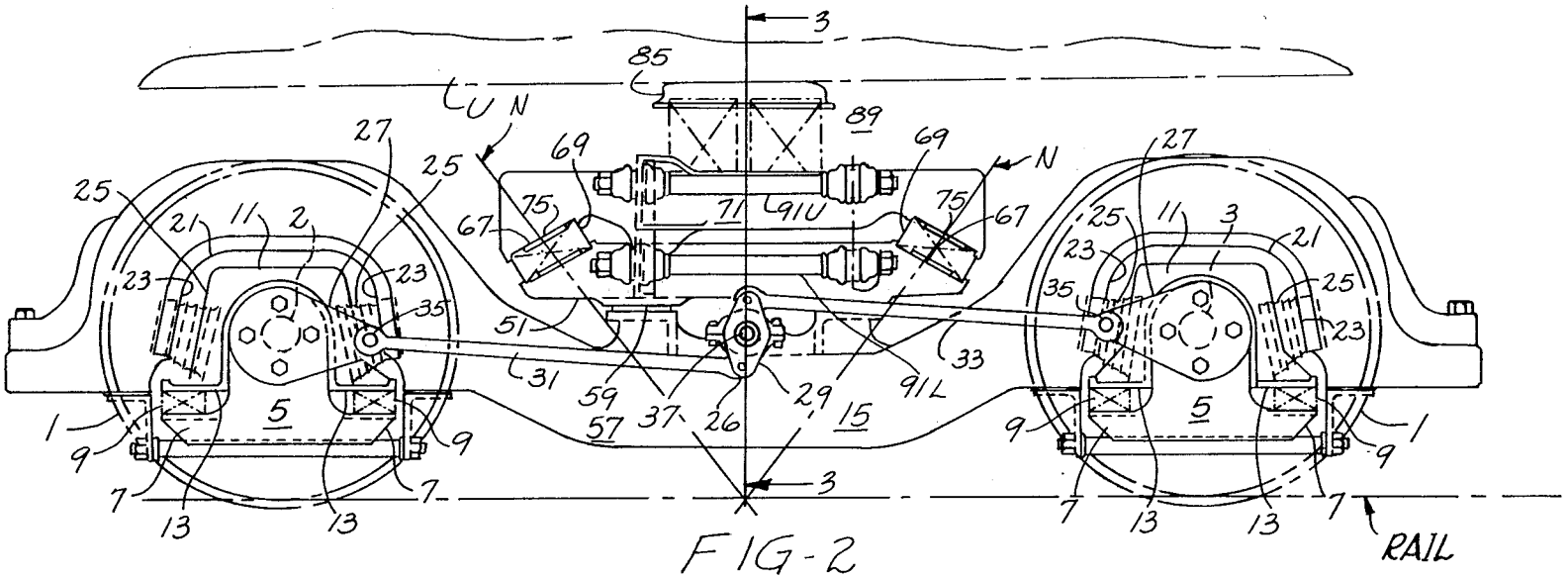
FIG. 2 is a side elevational view of the truck illustrated in FIG. 1.
Figure 3:
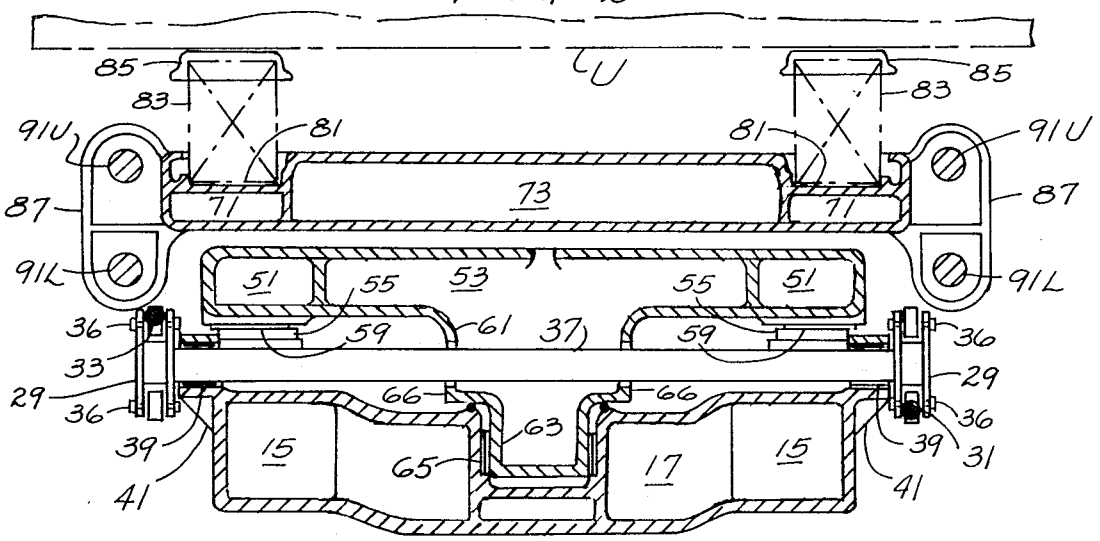
FIG. 3 is a transverse vertical sectional view taken along line 3—3 of FIG. 1.
Figure 4:
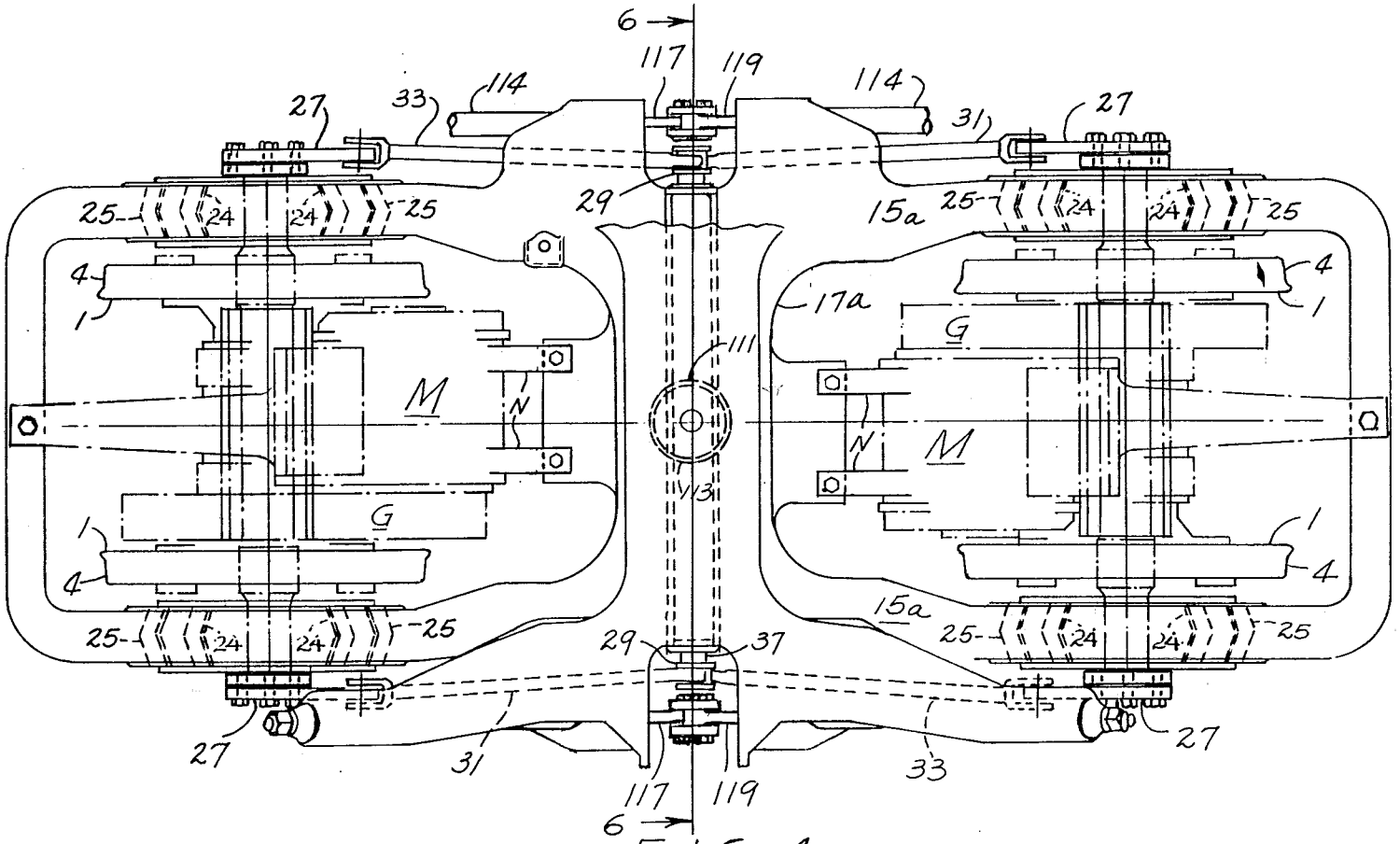
FIG. 4 is a plan view of a second embodiment of truck embodying the invention.
Figure 5:
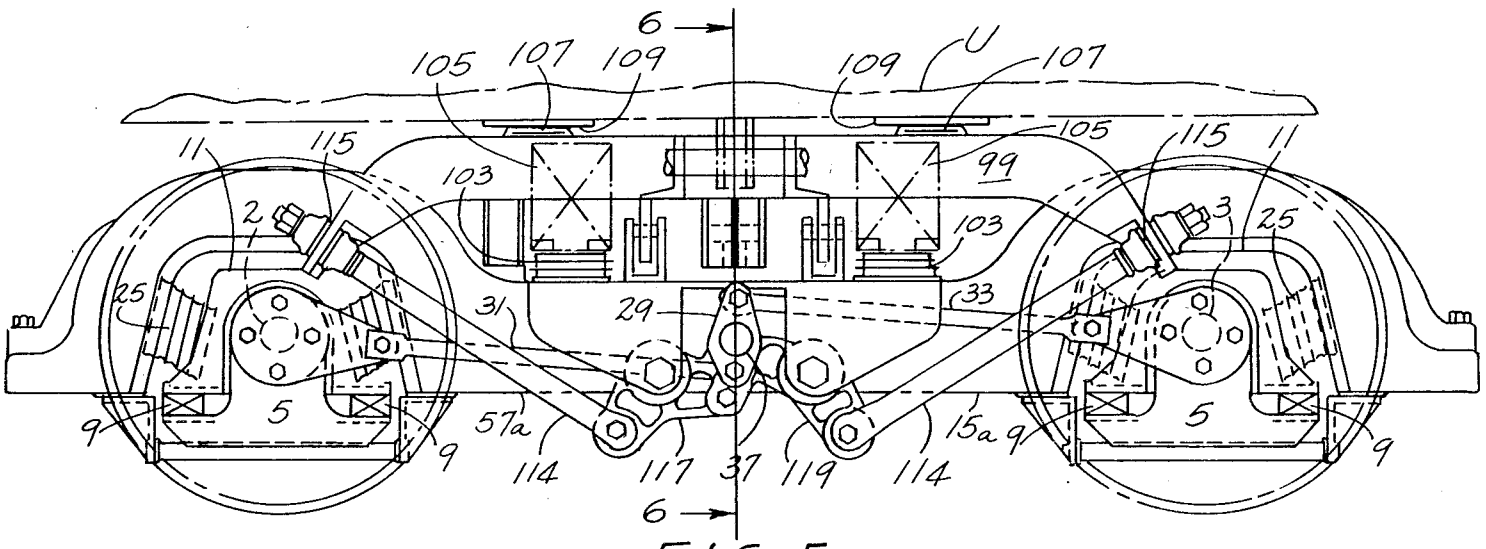
FIG. 5 is a side elevational view of the truck illustrated in FIG. 4.
Figure 6:
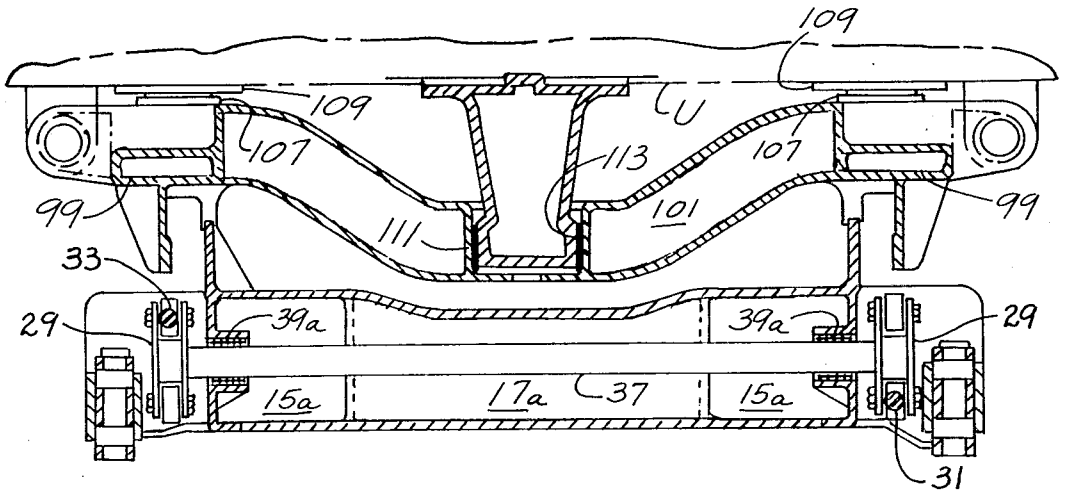
FIG. 6 is a transverse vertical sectional view taken along line 6—6 of FIG. 5.
Figure 7:
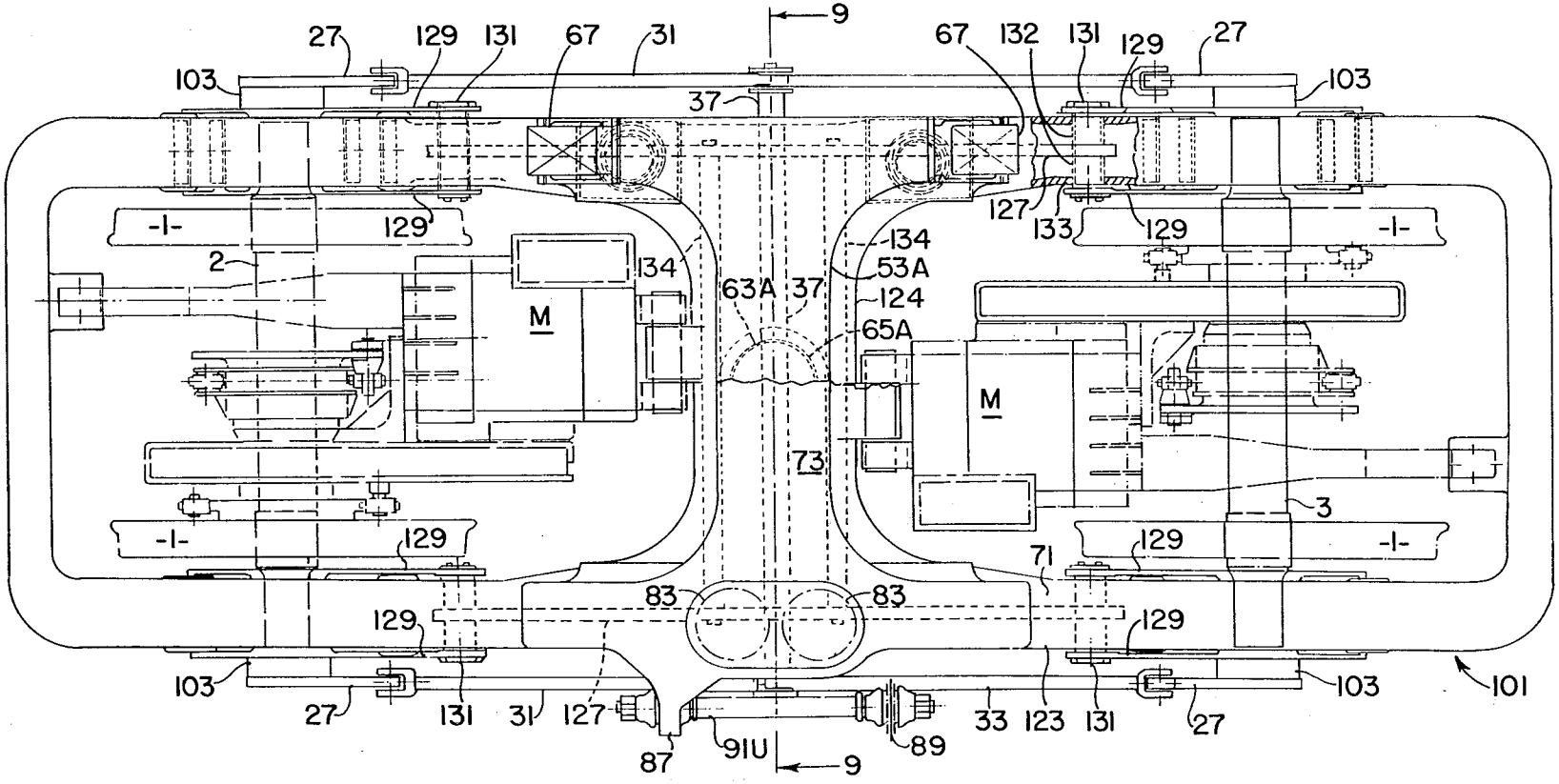
FIG. 7 is a plan view of a truck incorporating a preferred form of the invention.

The embodiment of the invention shown in FIGS. 4–6 utilizes the same primary suspension as the embodiment of FIGS. 1–3, the same motor and drive arrangement and the same axle interconnection comprising Z-linkages 29, 31, 33 and transverse connecting shaft 37, and these parts function in the same manner as in the embodiment of FIGS. 1–3. The secondary suspension, however, is similar to that shown in FIGS. 3–5 of K. L. Jackson U.S. Pat. No. 4,231,296, in which a bolster having longitudinally extending side members 99 connected by transverse center member 101 is supported by longitudinally spaced elastomeric pads and upright coil springs 105 in series and supports underframe U by four transversely and longitudinally spaced flat bearings 107 in slidable engagement with mating bearing 109 on underframe U. Traction forces are transmitted from the bolster 99, 101 to underframe U by a swivel bearing comprising cylindrical recess 111 at the center of bolster transverse member 101 and mating cylindrical boss 113 depending from underframe U. For locating the effective level of tractive force transmission from the truck to the underframe substantially at rail level and thus minimizing the vertical moment arm through which traction forces act to cause axle-to-axle load transference, the bolster is connected to the frame side members **15*a* by pairs of links 114, pivotally secured at their upper ends to the ends of the bolster side members at 115 and at their lower ends to linked bell cranks 117 and 119 pivoted on the frame side members 15*a*, links 114** converging so that their axial projections intersect at rail level.

Operation of the embodiment of FIGS. 4–6 is similar to that of the embodiment of FIGS. 1–3, except that the elimination of axle-to-axle load transference is accomplished in FIGS. 4–6 by the inclined link mechanism 114–119 instead of the inclined elastomeric pads of FIGS. 1–3.

In the embodiment of the invention illustrated in FIGS. 7–10, the wheels, axles, motors, motor supports and drive are essentially the same as in the embodiment illustrated in FIGS. 1–7. The mounting of the sub-bolster on the frame and the bolster on the sub-bolster and the support of the underframe on the bolster and the longitudinal anchors or draft links connecting the bolster to the underframe are similar to the embodiment of FIGS. 1–10 and the same reference characters will be used herein to denote similar parts.

Figure 8:
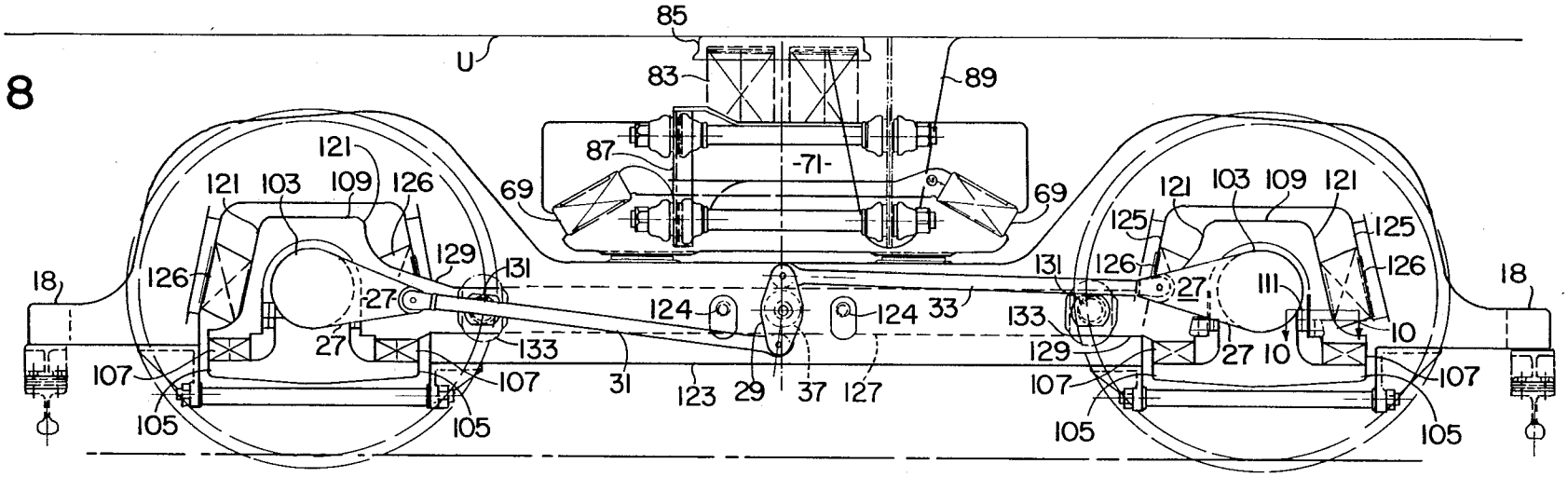
FIG. 8 is a side elevational view of the truck illustrated in FIG. 7.
Figure 10:
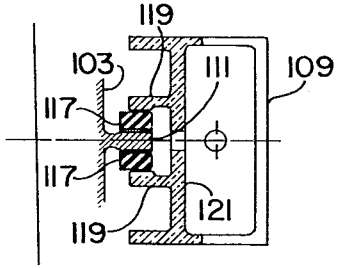
FIG. 10 is a horizontal sectional view taken along line 10—10 of FIG. 8.
Figure 9:
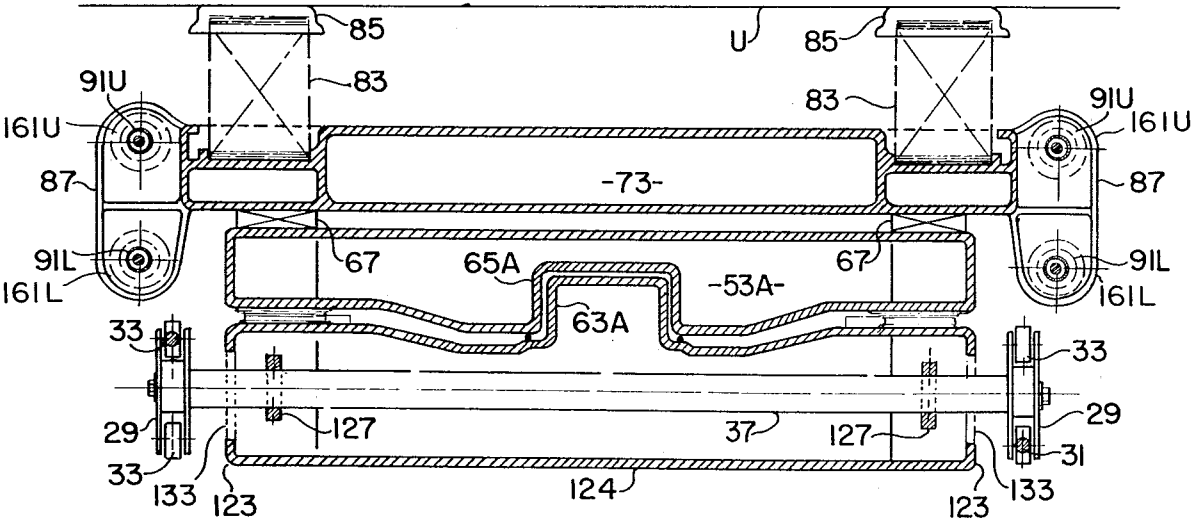
FIG. 9 is a transverse vertical sectional view taken along line 9—9 of FIGS. 7 and 8.

The construction of the truck frame denoted generally by the numeral 101 in FIGS. 7–10 and of the journal boxes and yokes is somewhat different from that illustrated in connection with the previous embodiment. In the embodiment of FIGS. 7–10, as best seen in FIGS. 8 and 10, each journal box 103 is provided with fore and aft upwardly facing wings 105 which support flat horizontal elastomeric pads 107 on which the horizontal bottom surfaces of a yoke 109 rests, the function of elastomeric pads 107 being to accommodate principally longitudinal movements of the journal box 103 with respect to the associated yoke 109 as required by yawing movements of the respective axle. To minimize lateral movements of the jouranl box 103 with respect to yoke 109, journal box 103 has fore and aft abutments 111 which mount on each of their oppositely directed vertical faces longitudinally of the truck a flat elastomeric pad 117, and the surfaces of the yoke 109 opposing the fore and aft surfaces of the journal box 103 are provided with transversely spaced abutments 119 having spaced vertical surfaces embracing journal box abutments 111 and elastomeric pads 117, whereby to accommodate freely longitudinal movements of the yoke on the journal box while opposing substantial movements of the journal box transversely of the yoke. The journal box abutments 111 are located near the level of the axle center, thereby reducing to a minimum any couple between the journal centers and the abutments which would act transversely of the truck responsive to lateral movements of the axle and tend to tip the journal box transversely with respect to the axle. For supporting the truck frame 101 on the journal box and yoke assembly, the fore and aft surfaces 121 of yoke 109 are slightly inclined toward each other and are flat and the end portions of the truck frame side members 123 are similarly inclined with flat transverse surfaces 125 and elastomeric pad devices 126 are interposed between the opposite inclined yoke and frame pedestal surfaces to provide a resilient support of the truck frame on the yokes with minimal lateral resistance. The truck frame side members 123 and center transom 124 are preferably of rectangular, or box, transverse section, and to provide a support for Z-link shaft 37 which passes through transom 124, a longitudinally extending beam 127 is positioned within box section frame side members and is directly supported from the respective yoked by arms 129 on the yokes inboard and outboard of the side members 123. Arms 129 are connected by transverse pins 131 extending through appropriate holes 133 in the inner and outer walls of the truck frame side members 123 and cylindrical sleeve-like spacers 132 are mounted on pins 131 for maintaining the beams 127 centered transversely between arms 129 on yokes 109. Shaft 37 is journaled in beams 127 at the centers thereof and the outer walls of the frame side members are formed with central vertically elongated apertures which permit the passage therethrough of shaft 37 and accommodate vertical movements of the frame resulting from the resilient support of the frame on yoke 101 with respect to shaft 37. For preventing relative movements of beams 127 in the horizontal plane while permitting relative tilting movements of the beams 127 in their respective vertical planes as may be required by relative vertical movements of journal box-yoke assemblies 103, 109, beams 127 are tied to each other by means capable of flexing in longitudinal vertical planes, while remaining rigid in the horizontal plane, exemplified by longitudinally spaced transversely extending tubes 134 bolted at their opposite ends to opposite beams 127. From the foregoing description, it will be seen that since vertical movement of yokes 109 on journal boxes 103 is resisted by the high resistance to compression of elastomeric pads 107 by which the yokes are supported from the journal boxes, there will be virtually no vertical movement between shaft-supporting beams 127 and the journal boxes, while the pin connection of shaft supporting beam 127 to yoke arms 129 will prevent any longitudinal movement of beams 127 with respect to the associated yokes, thereby eliminating any parasitic vertical motion of the Z-linkages with respect to the journal boxes and consequent parasitic longitudinal movements of the journal boxes to which the links are connected, as would be the case if the transverse shaft 37 were journaled in the truck frame side members 126 and thereby be subject to vertical movements of the truck frame side members permitted by elastomeric pads 127. It will be seen from FIG. 9 that frame transom 124 is provided at its center with an upstanding male swivel bearing member 63A which is swivelly received in a mating female bearing member in sub-bolster transverse member 53A, thereby providing clearance in truck frame transom 124 for shaft 37.

Operation of the truck illustrated in FIGS. 7–10 is as follows: As the truck and the locomotive body supported thereon is propelled along the track by traction motors M, elastomeric pads 126 yield in shear to permit relative vertical movements between the truck frame 101 and the journal box mounted yokes 109, whereby to accommodate the truck to vertical irregularities in the track rails and to cushion the frame from shocks received therefrom by the wheels. As the locomotive rounds a curve in the track, the truck frame swivels about vertical axis pivot members 63A, 65A, the profiled treads of wheels 1 causing axles 2 and 3 to assume positions generally radial of the track curve, such movements of the axles with respect to the truck frame being accommodated freely by shear longitudinally of the truck in horizontal pads 109, and links 31 and 33 on the inner side of the track curve urge inner lever 29 in the counterclockwise direction as viewed from the inner side of the curve, while links 31 and 33 urge outside lever 29 to move in a clockwise direction as viewed from the outer side of the curve. Since both levers 29 are fixed to the ends of shaft 37 their movements are identical as described hereinbefore in connection with the embodiment illustrated in FIGS. 1–6. As this occurs, the mounting of shaft 37 is maintained at a constant height above the track rails at the respective sides of the truck, i.e., on a line connecting the journal centers at the respective sides by reason of the journaling of shaft 37 in longitudinal beams 127 and the mounting of beams 127 on arms 129 on yokes 109. Thus by preventing parasitic vertical movements of the fulcrums of levers 29 relative to the associated journal boxes and corresponding longitudinal movements of these fulcrums due to tipping of the truck frame about the low level traction point, corresponding parasitic longitudinal movements of the outer ends of links 31 and 33 with corresponding parasitic longitudinal movements of the journal boxes to which they are connected will be substantially prevented. It will be seen that relative transverse and longitudinal movements of beams 127 will be opposed by their connections via pins 131 and arms 129 to yokes 109 and that the transverse connections of beams 127 by tubes 134 also prevent relative longitudinal movement between beams 127 and consequent longitudinal offset of Z-linkages 29, 31, 33 with respect to each other, thus assisting the truck frame to maintain beams 127 in tram.

Figure 11:
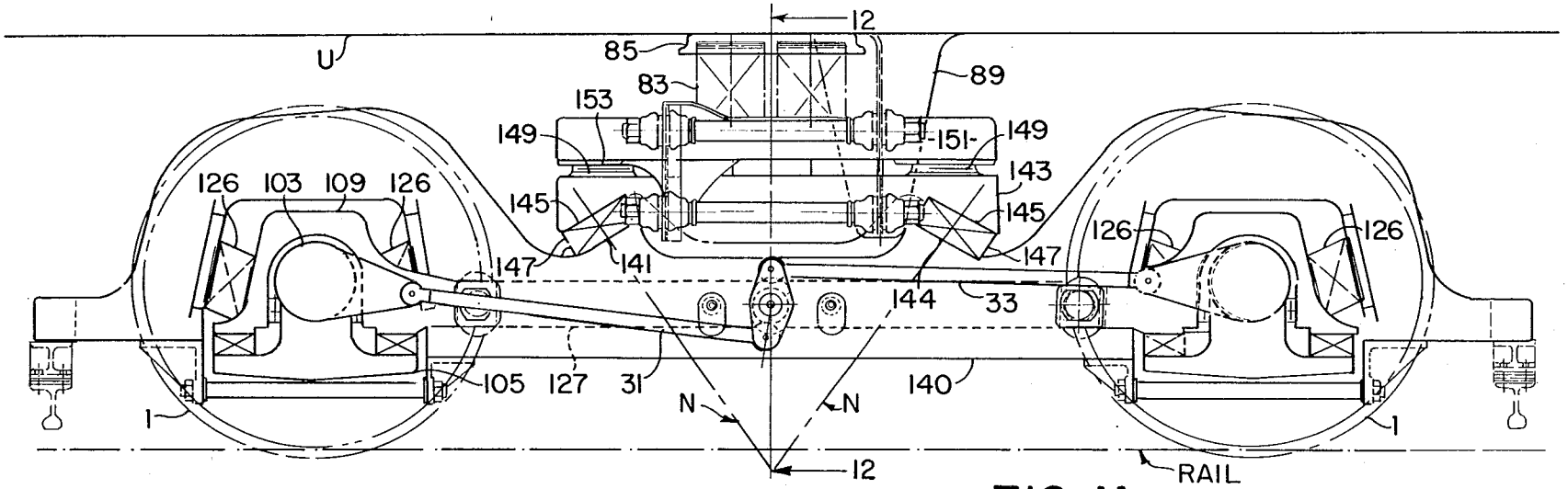
FIG. 11 is a side elevation of a modified form of the truck illustrated in FIGS. 7–10 showing a different means for mounting the bolster on the truck frame.
Figure 12:
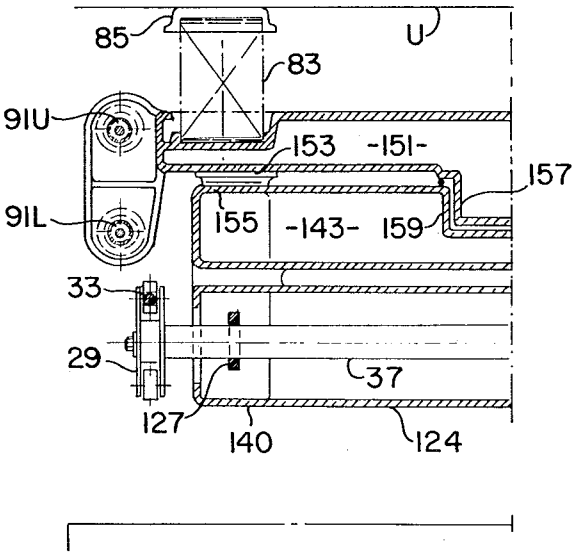
FIG. 12 is a half transverse vertical section taken along line 12—12 of FIG. 11.

In FIG. 11, the truck frame side member 140 is formed with longitudinal sloping surfaces 141, the normals to which intersect in the region of the intersection of the transverse center plane of the truck with the track rails and a sub-bolster 143 is formed on its lower surface with correspondingly sloping downwardly facing surfaces 145, flat elastomeric pads 147 being interposed between frame surfaces 141 and sub-bolster surfaces 145. The top of sub-bolster 143 is formed at its corners with flat bearing surfaces 149 and a main bolster 151 is formed with corresponding downwardly facing bearing surfaces 153, vertically unyieldingly but horizontally slidably seated on sub-bolster upwardly bearing facing surfaces 149, main bolster 151 swivelly connected to sub-bolster 143 by a vertical axis male cylindrical bearing 157 rotatably received in a mating female bearing 159 in sub-bolster 143, whereby swivel of sub-bolster 143 and the truck frame are permitted with respect to main bolster 151. At its sides, main bolster 151 supports upwardly extending coil springs 83, which in turn support locomotive underframe U. For transmitting traction and braking forces from main bolster 151 to underframe U while accommodating vertical movements of underframe U with respect to main bolster 153, main bolster 153 is formed at each side with upstanding and depending brackets 161 and 161 to which are pivotally connected longitudinal anchor links 91U and 91L respectively and the latter are connected at their opposite ends to bracket 89A depending from underframe U. It will be seen from this modification that the inclined pad support of the sub-bolster 143 on truck frame side members 140 and the non-tilting relationship between the sub-bolster and the main bolster and between the main bolster and the underframe U effected respectively by the bearings 149, 153 and the anchor links 91U and 91L will cause longitudinal traction and braking forces to be transmitted from the truck to the underframe effectively at rail level and thus eliminate the formation of couples tending to tip the entire truck assembly relative to the axles and thereby cause substantial axle-to-axle load transference. This arrangement of the bolster and sub-bolster assembly also provides for relative swivel movements of the truck with respect to the underframe by elevation of the swivel connection to a substantially higher level than in the previous embodiments, in which the sub-bolster is swivelly mounted on the truck frame. This modified bolster - sub-bolster - truck frame arrangement is particularly advantageous in a radial axle truck having axle-to-axle linkage connections in that the relatively high location of the mating swivel bearings 157, 159 provides maximum clearance in the central region of the truck for placement of such interconnecting linkages.

The details of the construction may be varied substantially without departing from the spirit of the invention and the exclusive use of such modifications as come within the scope of the claims is contemplated.

I claim:

1. In a railway vehicle truck, a pair of axles spaced apart longitudinally of the truck and each mounting a pair of transversely spaced flanged wheels having profiled generally frusto-conical treads, journal bearings mounted on the ends of said axles, a rigid truck frame having longitudinally extending side members resiliently supported on said journal bearings, longitudinally extending beams supported from and substantially fixed vertically with respect to said journal bearings at the respective sides of the truck, a transversely extending shaft journaled in said beams intermediate said axles, and thereby maintaining said shaft at a substantially constant height from the rails irrespective of vertical movements of the truck frame relative to the journal bearings, separate Z-linkages at each side of the truck comprising generally upright levers fixed to the ends of said shaft outboard of the sides of said truck frame and a pair of links at each side of the truck, one link of each pair being pivotally secured at one end to the upper end of the respective lever and the other link of each pair being pivotally secured at one end to the lower end of the respective lever, the ends of all said links remote from the ends secured to said levers being pivotally connected respectively to said journal bearings at the respective sides of the truck, the links at the opposite sides of the truck connected to the upper end of the respective levers being connected at their oposite ends to each of one pair of diagonally opposite journal bearings, and the links at the opposite sides of the truck connected to the lower ends of the respective levers being connected at their opposite ends to each of the other pair of diagonally opposite journal bearings, whereby to couple wheel induced yawing movements of the axles in opposite senses to permit radial positioning of the axles on curved track and to oppose hunting movements of the axles.

2. In a railway vehicle truck according to claim 1, said truck frame side members being formed with downwardly open pedestal jaws adjacent their ends embracing the respective journal bearings, each of said journal bearings having upwardly facing surfaces, flat elastomeric pad devices supported on said upwardly facing surfaces, a yoke supported on said pads, and resilient means carried by said yoke directly supporting said truck frame side members for substantially vertical movements only thereon, yawing movements of said axles with respect to said yokes and said truck frame being accommodated through horizontal shear in said flat elastomeric pad devices.

3. In a railway vehicle truck according to claim 2, said pedestal jaws having sloping sides diverging from top to bottom and said yokes having correspondingly diverging opposing sides, said resilient means comprising inclined elastomeric pad devices positioned between said sloping surfaces of said pedestal jaws and of said yokes.

4. In a railway vehicle truck according to claim 3, said inclined elastomeric pad devices being of generally V-section in plan with their apices pointing longitudinally of the truck in opposite directions, whereby to oppose substantial transverse movements of said yokes with respect to said truck frame.

5. In a railway vehicle truck according to claim 2, said longitudinally extending beams being supported directly from said yokes and extending therebetween at the respective sides of said trucks.

6. In a railway vehicle truck according to claim 5, said truck frame side members being of hollow cross section between said pedestal jaws and said longitudinally extending beams being positioned within the respective frame side members.

7. In a railway vehicle truck according to claim 6, said yokes having arms extending longitudinally toward the center of the truck respectively inboard and outboard of the respective truck frame side members, pivotal connecting means extending transversely between said arms of each yoke through the respective longitudinal beam for directly supporting the latter from the respective yokes.

8. In a railway vehicle truck according to claim 7, said pivotal connecting means comprising a pin and sleeve-like spacers thereon between said yoke arms and said longitudinal beam for centering said longitudinal beam in the respective frame side member.

9. In a railway vehicle truck according to claim 6, said truck frame including a hollow center transom rigidly connecting said frame side members to each other, said shaft being positioned within said center transom with its end portions mounting said levers projecting outwardly through said frame side walls, said side walls being apertured to accommodate relative vertical movements between said beam and said frame.

10. In a railway vehicle truck according to claim 2, said pedestal jaws having sloping sides diverging from top to bottom ad said yokes having correspondingly diverging opposing sides, said resilient means comprising inclined elastomeric pad devices positioned between said sloping surfaces of said pedestal jaws and of said yokes, said elastomeric pad devices positioned between said sloping surfaces of said pedestal jaws and of said yokes, said elastomeric pad devices being of flat cross section in plan, thereby facilitating transverse and longitudinal movement of said journal bearings relative to said truck frame necessitated by steering movements of said axles, and said journal bearings and said yokes being formed with opposing longitudinally extending vertical surfaces to oppose relative lateral movement between said journal bearings and yokes and thereby substantially restrict said journal bearings to movements longitudinally of the truck with respect to said yokes.

11. In a railway vehicle truck according to claim 10, said upwardly facing surfaces of said journal bearings being at a substantially different level than the axle center, said opposing vertical surfaces being near the level of the axle center whereby to minimize any couple responsive to lateral movements of the axle and tending to tip the journal bearings transversely on the axle.

12. In a railway truck according to claim 1, traction motors fully supported on said truck frame and each motor mounting a quill surrounding the respective axle and having radial clearance about the respective axle sufficient to accommodate maximum vertical movement of the truck frame with respect to the journal bearings and maximum wheel-induced yaw of the respective axles, and driving means mounted on said quills and drivingly connected to the respective traction motors and yieldably connected to said wheels for transmitting driving forces from said motors to said wheels irrespective of vertical and yaw deflections of said wheels from their normal positions co-axial with said quills.

13. In a railway vehicle truck according to claim 12, said motor, said quill and said driving means comprising an assembly having means supporting it securely on said truck frame.

14. In a railway vehicle truck according to claim 13, said truck frame having a transverse center transom intermediate said axles and rigidly connected to said side frames, said motors being positioned between said axles and said center transom and having projecting elements secured to said center transom, said truck frame having end transoms transversely connecting said frame side members longitudinally outboard of said wheels, each said motor having a torque arm extending over the respective axle and secured to the respective end transom.

15. In a railway vehicle truck according to claim 1, resilient means carried by said truck frame for supporting a vehicle body and permitting said truck frame to swivel about a vertical axis at the center thereof with respect to said body, and means for transmitting traction forces from said truck frame to the supported vehicle body effectively in the region of rail level, whereby to minimize the vertical moment arm through which traction forces act to cause axle-to-axle load transference.

16. In a railway vehicle truck according to claim 15, said means for transmitting traction forces from said frame to the supported vehicle body comprising a sub-bolster swivelly mounted at the center of said truck frame and held against tipping with respect thereto, said sub-bolster having upwardly facing end surfaces inclined in opposite directions longitudinally of the truck such that their central normals intersect substantially at rail level, flat elastomeric pad devices seated on said subbolster, a main bolster having downwardly facing end surfaces seated on said last-named elastomeric pad devices, and upright springs seated on the sides of said main bolster for directly supporting a supported vehicle underframe for vertical and lateral resilient movements with respect to said main bolster, and means maintaining said main bolster against tilting longitudinally with respect to said underframe while accommodating freely lateral and vertical deflections of said last-named spring devices.

17. In a railway vehicle truck according to claim 15, said means for transmitting traction forces from the truck frame to the vehicle body comprising a pair of upwardly facing surfaces on said truck frame inclined in opposite directions longitudinally of the truck such that their central normals intersect in the region of rail level, flat elastomeric pad devices seated on said inclined surfaces of said frame, a sub-bolster having downwardly facing surfaces at each side parallel to said inclined surfaces of said frame and seated on said elastomeric pad devices, a main bolster swivelly supported on said sub-bolster and held against tipping with respect thereto, upright springs seated on the sides of said main bolster for vertical and lateral resilient movements with respect to said main bolster, and means maintaining said main bolster against tilting longitudinally with and against swivel with respect to said underframe while freely accommodating lateral and vertical deflections of said spring devices.

* * * * *